US006296583B1

(12) United States Patent
Tatar, Sr.

(10) Patent No.: US 6,296,583 B1
(45) Date of Patent: Oct. 2, 2001

(54) BREAKAWAY BASKETBALL GOAL

(76) Inventor: Walter J. Tatar, Sr., 411 W. Hensley Rd., Champaign, IL (US) 61822

( * ) Notice: Subject to any disclaimer, the term of this patent is extended or adjusted under 35 U.S.C. 154(b) by 0 days.

(21) Appl. No.: 09/427,569

(22) Filed: Oct. 26, 1999

(51) Int. Cl.[7] ..... A63B 63/08
(52) U.S. Cl. ..... 473/486
(58) Field of Search ..... 473/447, 448, 473/472, 479, 480, 481, 482, 483, 484, 485, 486, 488

(56) References Cited

U.S. PATENT DOCUMENTS

| | | | |
|---|---|---|---|
| 3,462,143 | * | 8/1969 | Bidelman et al. . |
| 4,365,802 | | 12/1982 | Ehrat . |
| 4,438,923 | | 3/1984 | Engle et al. . |
| 4,534,556 | | 8/1985 | Estlund et al. . |
| 4,575,079 | | 3/1986 | De Faveri . |
| 4,583,732 | | 4/1986 | Allen . |
| 4,676,503 | | 6/1987 | Mahoney et al. . |
| 4,799,679 | | 1/1989 | Obram . |
| 4,805,904 | | 2/1989 | Nye . |
| 5,006,007 | | 4/1991 | Fischer et al. . |
| 5,154,414 | | 10/1992 | Auer et al. . |
| 5,163,676 | * | 11/1992 | Taub . |
| 5,388,821 | | 2/1995 | Blackburn . |
| 5,480,139 | | 1/1996 | Owen, Jr. et al. . |
| 5,628,506 | | 5/1997 | Vaught . |
| 5,716,294 | | 2/1998 | Childers et al. . |
| 6,053,826 | * | 4/2000 | Koole . |

* cited by examiner

*Primary Examiner*—William M. Pierce
(74) *Attorney, Agent, or Firm*—Wood, Phillips, VanSanten, Clark & Mortimer

(57) ABSTRACT

A basketball goal has a hoop connected through a breakaway mechanism with a support, independently of the backboard. A force on the hoop is transmitted to the support and is not applied to the backboard.

5 Claims, 2 Drawing Sheets

BREAKAWAY BASKETBALL GOAL

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention is concerned with a basketball goal and more particularly with a breakaway basketball goal connected with a support, independently of the basketball backboard.

Basketball goals are often subjected to damaging forces as from vigorous dunks or from a player hanging on the hoop. Breakaway mechanisms, many incorporating springs, have been proposed which reduce but do not eliminate damage to the backboard and to the hoop.

BRIEF SUMMARY OF THE INVENTION

It is a principal feature of my goal that the hoop and breakaway mechanism are connected with a support, as a post, independently of the backboard. Accordingly, a force applied to the goal is transmitted directly through the breakaway mechanism to the support. No force is transmitted from the goal to the backboard.

More particularly, the breakaway mechanism is mounted on the support, behind the backboard and includes a pivoted arm which extends forwardly through a slot in the backboard, the hoop being connected with the arm.

A further feature of the goal is that the breakaway mechanism includes a resilient element applying a force to the arm urging the hoop upwardly and a stop limiting upward movement of the arm to position the hoop in a horizontal attitude.

Another feature of the goal is that the force urging the hoop upwardly is adjustable.

Further features and advantages of the goal will be apparent from the following Specification.

DETAILED DESCRIPTION OF THE INVENTION

A basketball goal 10 is typically mounted on a support post 11 which extends upwardly from a base (not shown) or which may be set in the ground. Backboard 12 is secured to mounting plate 13 affixed to the underside of the horizontally extending end portion 11*a* of the support post. Braces

14 extend from the upper portion of the backboard to the horizontal portion 11*a* of the support post.

Figure 1:
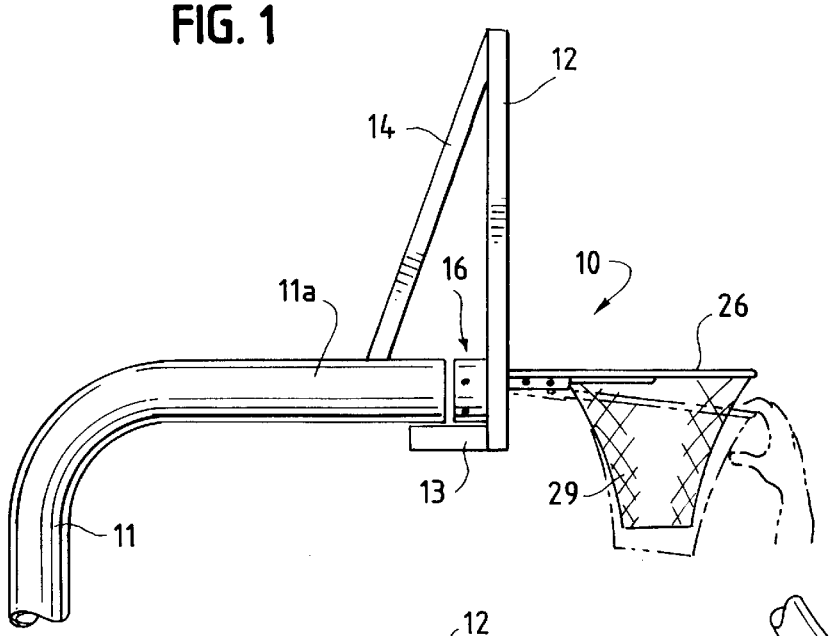
FIG. 1 is a side elevation of a support with a backboard and goal independently mounted thereon.
Figure 2:
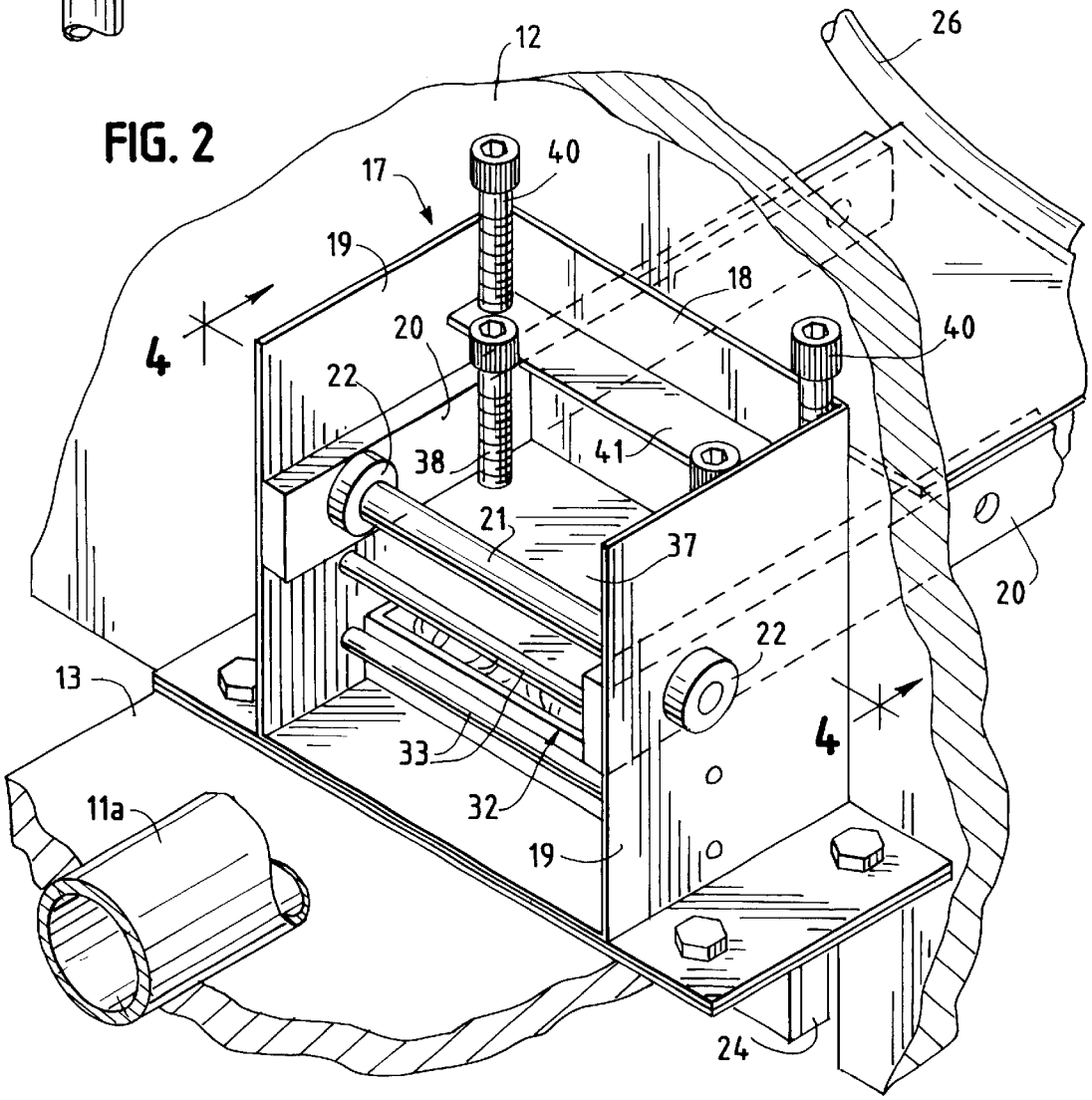
FIG. 2 is an enlarged rear perspective of the end of the support, and portions of the backboard, goal and the breakaway mechanism, with parts omitted for clarity.
Figure 3:
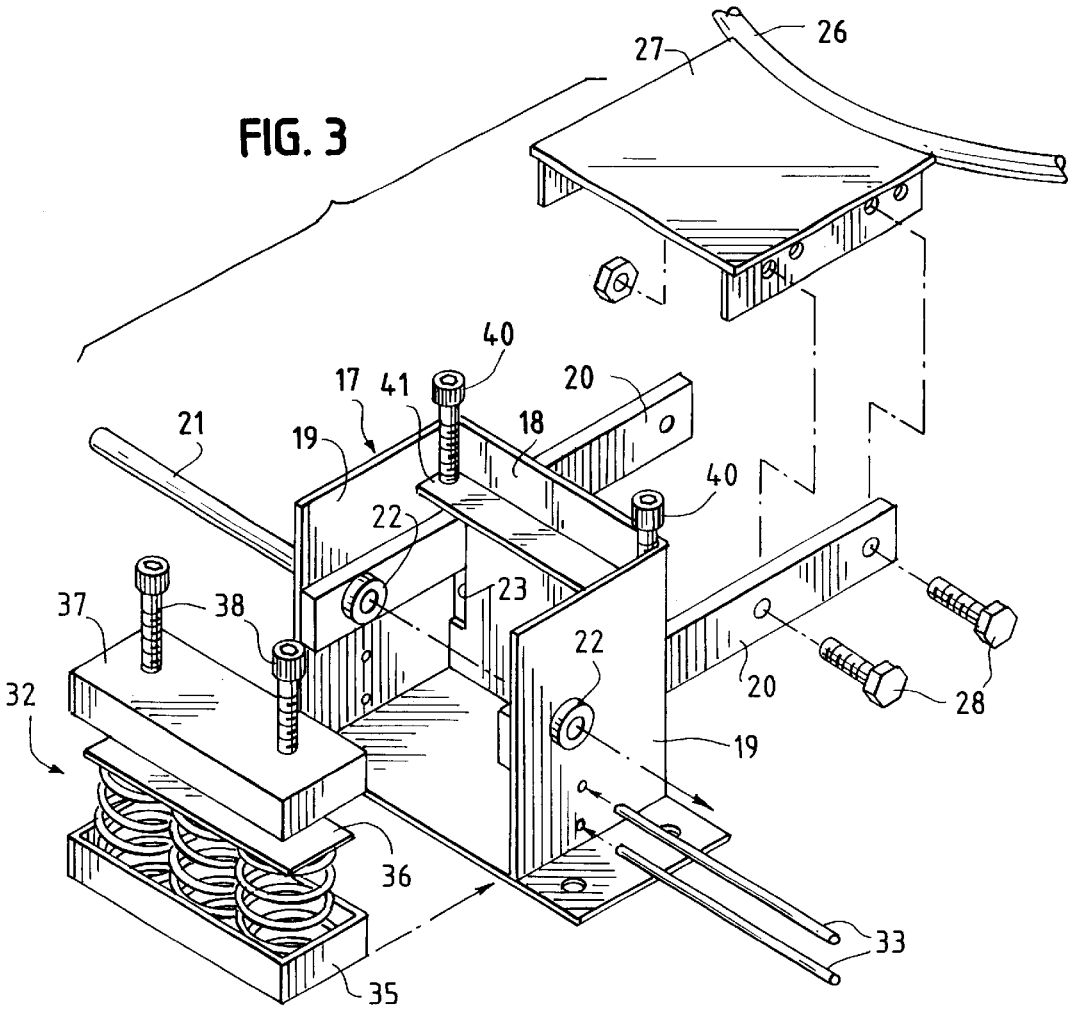
FIG. 3 is an exploded rear perspective of the breakaway mechanism.
Figure 4:
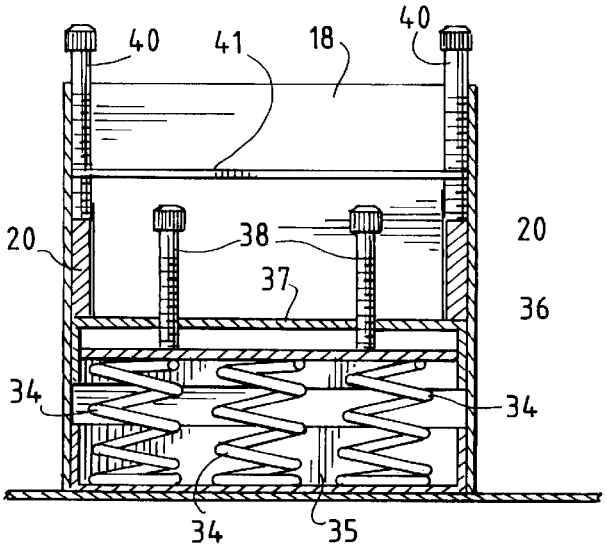
FIG. 4 is a vertical section taken along line 4—4 of FIG. 2.

Breakaway mechanism 16 is mounted behind the backboard on plate 13 and is best seen in FIGS. 2–4. Housing 17 has a front wall 18 adjacent the rear surface of backboard 12 and a pair of laterally spaced, parallel side walls 19. A pair of arms 20 on shaft 21 are pivoted to side walls 19 at bearings 22. Arms 20 extend forwardly along the inner surface of walls 19, through slots 23 in front wall 18 and aligned slots 24 in the backboard 12. Details of all the slots are not shown.

Hoop 26 has a mounting plate 27 affixed thereto which is connected with the outer ends of arms 20 by bolts 28. A net 29 is suspended from hoop 26.

Resilient element 32 is located in housing 17, below arms 20 and in front of shaft 21. Rods 33 extend between side walls 19 behind resilient element 32 to prevent its accidental removal. Resilient element 32 supports arms 20 for breakaway deflection in the event a downward force which exceeds the upward force of the resilient element is applied to the hoop 26, as from the impact of a dunk shot or the weight of a player hanging from the hoop.

Resilient element 32, best seen in FIGS. 3 and 4, has three compression coil springs 34 seated in a base 35. Compression plate 36 rests on top of springs 34 and a cover 37 bears against the lower surface of arms 20. Compression adjustment screws 38 are threaded through cover 37 and engage compression plate 36. Stop screws 40 are threaded through an angle plate 41 affixed to the rear surface of front wall 18 above arms 20 and engage the upper edge of each arm to limit upward movement of the arms.

Compression screws 38 are adjusted to establish the minimum or breakaway force required to deflect hoop 26 and arms 20. For example, the force set for junior high school basketball players would be substantially less than the force set for adult players. Stop screws 40 are set to adjust the undeflected position of arms 20 and hoop 26.

After a deflecting force is removed from hoop 26 the hoop and arms 20 return to the undeflected, horizontal position.

Springs 34 may be replaced with other resilient material. For example, one or more tennis balls or a block of resilient foam material might be substituted for the springs between compression plate 36 and base 35.

The resilient element 32 may be removed from the breakaway mechanism by retracting compression screws 38 and removing the rods 33.

Figure 5:
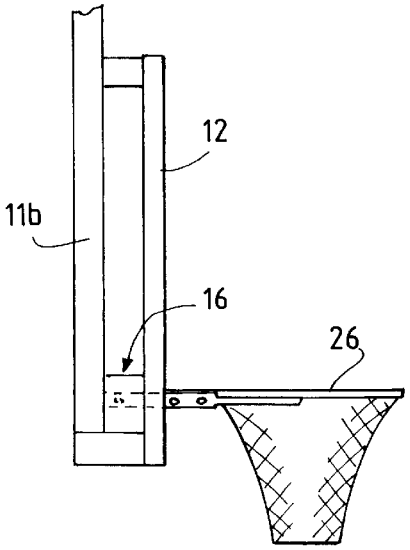
FIG. 5 is a side elevation of an alternate support with which the backboard and goal are mounted from above.

Support for the backboard and breakaway goal need not be from below. The backboard and goal may be suspended on a post 11*b* which depends from above, FIG. 5. Alternatively, the backboard and breakaway mechanism may be secured to a wall, not shown.

Springs are not directly attached to the backboard. When hoop 26 is deflected, the force is transmitted directly through the breakaway mechanism 16 to support 11 or 11*b*. The backboard is not subject to damage.

An existing basketball goal may be converted for breakaway operation by removing the hoop, cutting slots in the backboard for arms 20 and installing the breakaway mechanism 16 on the support behind the backboard. The hoop is then secured to arms 20. Moreover, the breakaway mechanism and hoop may readily be removed during the off season to avoid damage from the elements in an outdoor basketball court or to prevent vandalism.

The breakaway mechanism is reliable in operation, uncomplicated in design, cost effective, and simple to install and adjust for the desired breakaway force.

I claim:

1. A basketball goal comprising;

a support;

a backboard connected to said support;

a hoop;

a breakaway mechanism mounted on said support behind said backboard, including:

a hoop carrying arm pivoted about a horizontal axis spaced behind the backboard;

a resilient element below the arm and forward of the axis, urging the arm upwardly;

a stop limiting the upward movement of said arm;

a cover plate between the resilient element and the arm, supporting said arm;

a compression plate between said cover plate and the resilient element; and a screw threaded in said cover plate and engaging the compression plate to adjust compression of the resilient element and the upward force applied to said arm, the arm having said hoop connected thereto, a force applied to the hoop deflecting the hoop and being transmitted through the breakaway mechanism to the support, no force being applied to the backboard.

2. The basketball goal of claim 1 in which said resilient element is a coil spring.

3. The basketball goal of claim 1 in which said resilient element is a body of resilient material.

4. The basketball goal of claim 1 including a plate above said arm and in which said stop comprises a screw threaded in said plate for adjusting the undeflected position of said arm.

5. A basketball goal comprising:

a support;

a backboard connected to said support, the backboard having a lower edge;

a hoop;

a breakaway mechanism mounted on said support behind the backboard and above the lower edge thereof, including a pair of laterally spaced hoop-carrying arms pivoted about a horizontal axis spaced behind the backboard, the arms extending forwardly through slots in the backboard;

a resilient element below the arms, forward of the axis and between the horizontal axis and backboard, urging the arms upwardly;

a stop limiting upward movement of said arms, the arms having said hoop connected thereto, a force applied to the hoop deflecting the hoop and being transmitted through the breakaway mechanism to the support, no force being applied to the backboard.

* * * * *